US009494909B1

(12) United States Patent
Roche et al.

(10) Patent No.: US 9,494,909 B1
(45) Date of Patent: Nov. 15, 2016

(54) TONER MICRO-CONTAINER

(71) Applicant: Xerox Corporation, Norwalk, CT (US)

(72) Inventors: Lee David Roche, Pittsford, NY (US); Leslie Wynn, Letchworth Garden (GB); Mohan Vijayalaya Pandian, Sankarankovil (IN); Sreedharan Deepak Nair, Bangalore (IN)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/824,127

(22) Filed: Aug. 12, 2015

(51) Int. Cl.
*G03G 15/08* (2006.01)
*G03G 21/16* (2006.01)

(52) U.S. Cl.
CPC ..... *G03G 21/16* (2013.01)

(58) Field of Classification Search
CPC ..... G03G 21/16; G03G 15/0874; G03G 15/0875; G03G 15/0879
See application file for complete search history.

(56) References Cited

U.S. PATENT DOCUMENTS 3,250,439 A 5/1966 Ferrari et al.
3,599,682 A * 8/1971 Altmann ..... G03G 15/0884 141/106
3,651,838 A * 3/1972 Albert ..... G03G 15/0855 141/284
4,237,943 A * 12/1980 Ermel ..... G03G 15/0855 141/284
4,307,763 A * 12/1981 Wang ..... G03G 15/104 138/89
4,456,154 A * 6/1984 Herriman ..... G03G 15/0875 141/363
4,489,765 A * 12/1984 Yamada ..... G03G 15/0855 141/1
5,079,591 A * 1/1992 Tomita ..... G03G 15/0855 399/262
5,325,765 A 7/1994 Sylvan et al.
5,614,996 A * 3/1997 Tanda ..... G03G 21/12 141/363
5,802,431 A * 9/1998 Nagashima ..... G03G 15/0855 222/DIG. 1
5,840,189 A 11/1998 Sylvan et al.
5,887,232 A * 3/1999 Phillips ..... G03G 15/0855 222/DIG. 1
6,304,739 B1 * 10/2001 Katsuyama ..... G03G 15/0874 222/DIG. 1
6,393,241 B1 * 5/2002 Matsumoto ..... G03G 15/0822 399/258
6,571,076 B2 * 5/2003 Kasahara ..... G03G 15/0855 399/258
6,607,762 B2 8/2003 Lazaris et al.
6,813,460 B2 * 11/2004 Sudo ..... G03G 15/0874 399/258
7,947,316 B2 5/2011 Kirschner et al.
8,929,776 B2 * 1/2015 Yamabe ..... G03G 15/0879 399/258

(Continued)

*Primary Examiner* — David Bolduc
(74) *Attorney, Agent, or Firm* — Gibb & Riley, LLC

(57) ABSTRACT

Printing devices have, among other components, a cartridge positioned within the interior of a device body to receive print media from a sheet feeder. A photoreceptor and marking material are maintained within the cartridge. The photoreceptor transfers marking material from within the cartridge in a pattern to the print media. The printing apparatus also includes a receptacle, that is potentially on the exterior of the device body, which is connected to a supply conduit. A storage container can be positioned in the receptacle. The storage container generally holds only marking material, and the storage container easily and conveniently resupplies the marking material to the cartridge through the supply conduit when the storage container is positioned in the receptacle (e.g., after the cartridge has consumed the original supply of marking material) so as to extend a useful life of the cartridge.

15 Claims, 6 Drawing Sheets

(56) References Cited

U.S. PATENT DOCUMENTS

2001/0041083 A1* 11/2001 Terazawa ..... G03G 15/0855 399/258
2002/0009310 A1* 1/2002 Kabumoto ..... G03G 15/0126 399/258
2002/0039502 A1* 4/2002 Matsumoto ..... G03G 15/0898 399/258
2004/0037591 A1* 2/2004 Schlageter ..... G03G 15/0865 399/258
2005/0013633 A1* 1/2005 Harumoto ..... G03G 15/0872 399/258
2005/0041998 A1* 2/2005 Fujii ..... G03G 15/086 399/258
2006/0002743 A1* 1/2006 Katsuyama ..... G03G 15/0881 399/258
2006/0263116 A1* 11/2006 Katsuyama ..... B65D 1/0292 399/258
2007/0116494 A1* 5/2007 Uno ..... G03G 15/0874 399/258
2008/0025743 A1* 1/2008 Hori ..... G03G 15/0877 399/61
2009/0277911 A1* 11/2009 Koide ..... B65D 77/062 220/495.08
2010/0092216 A1* 4/2010 Spence ..... G03G 15/0822 399/258
2011/0097094 A1* 4/2011 Hamano ..... G03G 15/0856 399/27
2012/0177406 A1* 7/2012 Suzuki ..... G03G 15/0874 399/120
2015/0063865 A1* 3/2015 Furuichi ..... G03G 21/1814 399/111

* cited by examiner

TONER MICRO-CONTAINER

BACKGROUND

Systems and methods herein generally relate to supplying marking material to printing devices and more particularly to devices and systems that resupply marking material.

Many different devices are used to supply marking material to printers. For example, inkjet printers often use ink cartridges that include liquid ink, printheads, and associated circuitry. Similarly, toner-based printing devices often use toner cartridges to supply powdered toner to the printing engine.

Conventional toner cartridges can include many components that increase the cost of the toner cartridge and make newly manufactured replacement toner cartridges relatively expensive. For example, toner cartridges can include augers, gears, photoreceptors, cleaning blades, development units, etc. Often these mechanical and electrical components have remaining useful life even after all of the toner has been consumed. Therefore, a thriving market exists related to refilling toner cartridges that are empty of toner, but otherwise still include useable printing components.

In view of this, users have been provided an option to return empty toner cartridges to organizations that will refill and refurbish the toner cartridge. Such organizations market "used" or "refilled" toner cartridges at a discount price relative to newly manufactured toner cartridges; however, even the price of used or refilled toner cartridges can be relatively high for certain situations. Also, the toner cartridges can be somewhat bulky, increasing the shipping costs for the user or the refilling organization. The size of the toner cartridges also creates an issue with respect to storage space, which encourages retailers and users to only maintain a very limited supply of unused toner cartridges.

In addition, home refill kits are sometimes available to allow users to refill toner cartridges with additional toner; however, such kits require the unskilled user to remove the toner cartridge from the printer, sometimes partially dismantle the toner cartridge, utilize injection devices to resupply the toner into the empty toner cartridge, etc. Therefore, such kits can be very cumbersome to use and messy. Refill kits are unattractive to many users because of the complexity of the refill procedure and the time required to refill the cartridge. Also, print toner is a strong marking material that can permanently stain items, and even if a small amount of toner spills during user toner cartridge refill, items can be undesirably marred with the toner powder.

SUMMARY

Exemplary printing devices herein have, among other components, a device body, a sheet feeder feeding print media within the interior of the device body, and a cartridge (which is sometimes referred to herein as a "separate marking material cartridge") positioned within the interior of the device body to receive the print media from the sheet feeder. A photoreceptor and marking material are maintained within the cartridge. The photoreceptor transfers marking material from within the cartridge in a pattern to the print media. The printing apparatus also includes a receptacle, that is potentially on the exterior of the device body, which is connected to a supply conduit. The supply conduit connects the receptacle to the cartridge.

A toner storage container can be positioned in the receptacle. The toner storage container generally holds only marking material (and potentially air) and the toner storage container easily and conveniently resupplies the marking material to the cartridge through the supply conduit when the toner storage container is positioned in the receptacle (e.g., after the cartridge has consumed the original supply of marking material) so as to extend a useful life of the cartridge. While the toner storage container resupplies marking material to the cartridge, the toner storage container is a physically separate component from the cartridge.

In more detail, the receptacle has a protrusion shaped to pierce the exterior of the toner storage container when the toner storage container is placed in the receptacle. The protrusion helps hold the toner storage container in place in the receptacle. In some structures, the supply conduit can include an auger that helps move the marking material from the receptacle to the cartridge (through the supply conduit).

As noted above, the receptacle has a protrusion that pierces the lower surface as the toner storage container, when the toner storage container is placed in the receptacle to form an opening in the lower surface. Also, the airtight and watertight interior of the toner storage container is larger than the protrusion, and this prevents the protrusion from piercing the upper surface of the toner storage container, keeping toner from being released anywhere except into the receptacle and conduit, so as to resupply marking material to the cartridge (e.g., cartridge) within an interior of the printing device. Additionally, the airtight and watertight interior of the toner storage container is larger than the auger, to accommodate the auger without piercing the upper surface of the toner storage container.

In some examples, the toner storage container itself has a planar upper ("first") surface that is parallel to an adjacent portion of the exterior of the device body (when the toner storage container is positioned in the receptacle) and a curved lower ("second") surface that has a shape matching the curved shape of the receptacle. The upper surface does not need to be planar, and the lower surface of the toner storage container is not necessarily curved, but instead is shaped to match the shape of the receptacle of the printing device. Irrespective of the shape of the toner storage container, an airtight and watertight interior is formed between the first surface and the second surface, and the airtight and watertight interior maintains only the marking material (and possibly air). Further, the upper ("first") surface and the lower ("second") surface can be made of different materials or the same material.

Also, the "marking material" discussed above can be toner, and the cartridge or "separate marking material cartridge" can be a toner cartridge. The toner cartridge maintains toner, and a photoreceptor is positioned within the toner cartridge. The toner cartridge supplies the toner to the photoreceptor, and the photoreceptor transfers the toner to print media.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, even the price of used or refilled toner cartridges can be relatively high for certain situations, and toner cartridges can be somewhat bulky, increasing the shipping costs and creating an issue with respect to storage space. In addition, home refill kits can be very cumbersome to use and messy. In view of such issues, the devices and systems disclosed herein provide replacement toner in easy to use and load toner micro-containers that are specifically designed and shaped to be loaded into matching receptacles of the printing device. When inserted into the receptacle, the toner micro-container is punctured, allowing toner to be dispensed to refill the toner cartridge through a white glove experience. Additionally, the toner micro-containers can be packaged in small quantities suitable for minimal printing requirements. This enables flexibility in purchases, for minimal capital outlay by the customer in low income markets.

Figure 1:
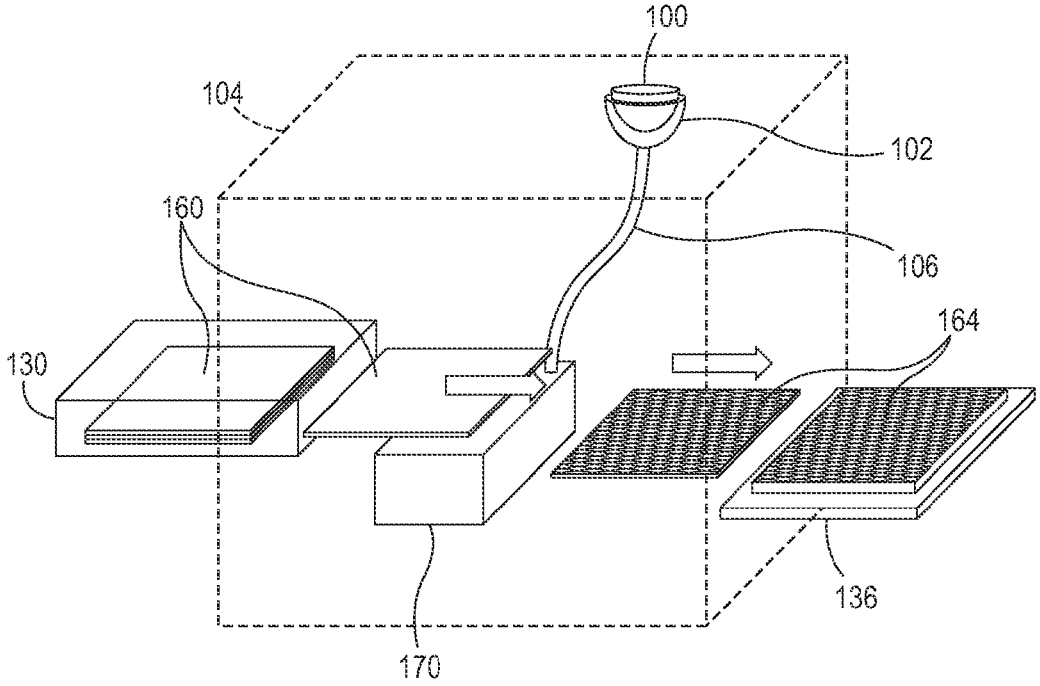
FIG. 1 is a schematic diagram illustrating printing devices herein.

FIG. 1 shows the exemplary printing devices herein containing, among other components, a device body 104, a sheet supply/feeder 130 feeding print media 160 within the interior of the device body 104, and a cartridge 170 (which is sometimes referred to herein as a "separate marking material cartridge") positioned within the interior of the device body 104 to receive the print media 160 from the sheet feeder 130. A photoreceptor 156 and marking material are maintained within the cartridge 170. The photoreceptor 156 transfers marking material 162 from within the cartridge 170 in a pattern to the print media 160 to output printed print media 164.

The printing apparatus also includes a receptacle 102, which is potentially on the exterior of the device body 104, which can be connected to a supply conduit 106. The supply conduit 106 connects the receptacle 102 to the cartridge 170. The supply conduit 106 comprises a stiff or flexible hollow tube of sufficient diameter to allow marking material to freely flow within the supply conduit 106.

Figure 2:
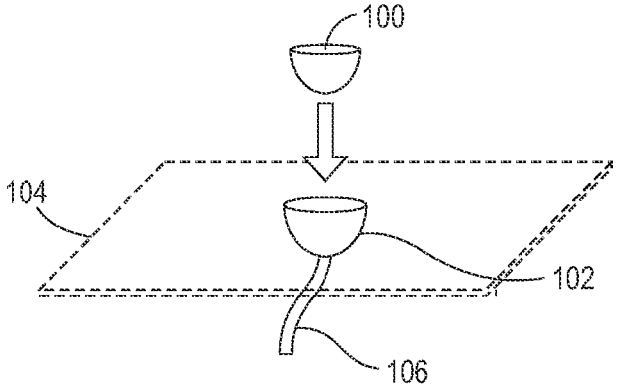
FIG. 2 is a schematic diagram illustrating a portion of a printing device herein.

As shown in FIG. 1, a toner storage container 100 can be positioned in the receptacle 102. As can be seen in FIG. 2, which illustrates a portion of the exterior of the body of the printing device 104, the toner storage container 100 is a separate component that is positioned into the receptacle 102 as indicated by the block arrow. After the toner has been delivered from the toner storage container 100 to the cartridge 170 through the supply conduit 106, the toner storage container 100 can be removed from the receptacle 102, in the direction opposite the block arrow shown in FIG. 2, and discarded or refilled.

The toner storage container 100 generally holds only marking material (and potentially air) and the toner storage container 100 easily and conveniently resupplies the marking material to the cartridge 170, without having to remove or perform any other action with the cartridge 170. Specifically, the toner storage container 100 resupplies the marking material to the cartridge 170 through the supply conduit 106 when the toner storage container 100 is positioned in the receptacle 102 (e.g., such as after the cartridge 170 has consumed its original supply of marking material) so as to extend the useful life of the cartridge 170. While the toner storage container 100 resupplies marking material to the cartridge 170, the toner storage container 100 is a physically separate component from the cartridge 170, as shown in FIG. 2.

Figure 3:
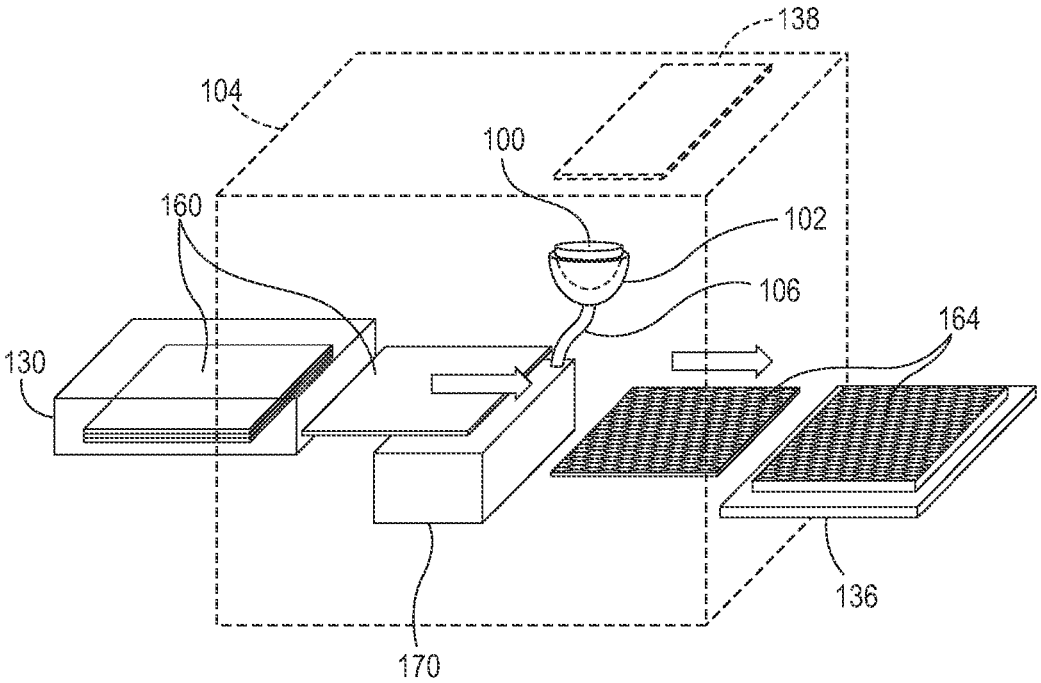
FIG. 3 is a schematic diagram illustrating printing devices herein.
Figure 4:
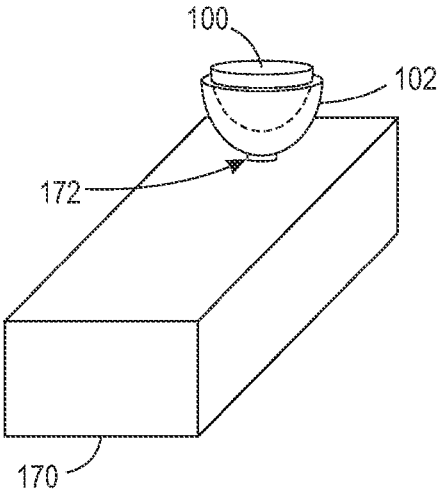
FIG. 4 is a schematic diagram illustrating a cartridge of a printing device herein.

FIGS. 3 and 4 illustrate alternative arrangements for the location of the receptacle 102 within the interior of the printing device 104. Specifically, in FIG. 3 the receptacle 102 is accessed through an access door 138 and is positioned at a location within the interior of the body of the printing device 104 that can be conveniently reached from the access door 138. In the arrangement shown in FIG. 3, the supply conduit 106 is somewhat shorter than when the receptacle 102 is positioned on the exterior of the body of the printing device 104, as is illustrated in FIG. 1.

Somewhat similarly, FIG. 4 illustrates that the receptacle 102 is positioned directly on the toner cartridge 170, thereby eliminating the need for a conduit 106. FIG. 4 also illustrates an opening 172 in the toner cartridge 170 that is connected either directly to the receptacle 102 or to the supply conduit 106 to allow the toner from the toner storage container 100 to enter the toner cartridge 170.

The structures shown in FIGS. 3 and 4 allow older machines to be easily retrofitted with a receptacle 102, without having to locate the receptacle 102 on the exterior of the body 104 (without having to cut holes in the exterior of the body 104). With the structure shown in FIG. 3, the receptacle 102 is easily mounted at any convenient location within the interior of the body 104 (e.g., by connecting the receptacle to any existing bracket or other interior structure). An opening 172 can be formed in the exterior of the cartridge 170 if one is not already present, and the supply conduit 106 can comprise a flexible hollow tube that is cut to length, such that the supply conduit 106 easily reaches the opening 172 in the toner cartridge 170.

Similarly, the structure shown in FIG. 4 allows a conventional toner cartridge to be replaced with the toner cartridge 170 that includes an integral receptacle 102. The structure shown in FIG. 4 allows the user to simply refill the toner cartridge 170 by placing a new toner storage container 100 within the receptacle 102, instead of having to replace the entire toner cartridge. The structure shown in FIG. 4 provides an even easier retrofit, because having the receptacle 102 integral with the toner cartridge 170 avoids having to mount the receptacle 102 within the interior of the body 104 and avoids having to connect the flexible conduit.

Therefore, as shown in FIGS. 1-4, rather than replacing an existing toner cartridge as is done conventionally, with the structures herein the user merely inserts a new toner storage container 100 into the receptacle 102 (potentially after removing a previously emptied toner storage container 100) to refill the existing toner cartridge 170. These structures allow the user to easily refill the existing toner cartridge 170 in a simple and clean process that does not involve handling the toner cartridge, and that substantially reduces the chance of the possibility of spilled toner.

Further, the toner storage containers 100 are less expensive, smaller, cleaner, and easier to handle than toner a cartridge, which makes the entire user experience much more acceptable. In addition, and depending upon design preferences, FIGS. 1-4 illustrate that the receptacle 102 can be positioned on the exterior of the body of the printing device 104 (as illustrated in FIG. 1); can be position within the interior of the body of the printing device 104 (as illustrated in FIG. 3); or can be an integral feature of the toner cartridge 170 (as illustrated in FIG. 4). These different designs allow existing printers (that were not originally manufactured to include a receptacle 102) to also use the features of the designs described herein.

Figure 5A:
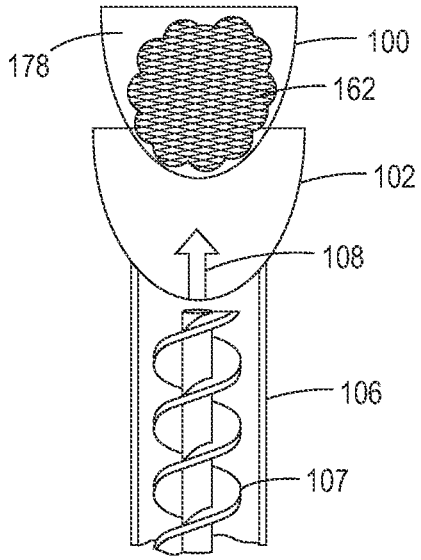
FIGS. 5A and 5B are schematic diagrams illustrating a toner storage container and associated receptacle of a printing device herein.
Figure 5B:
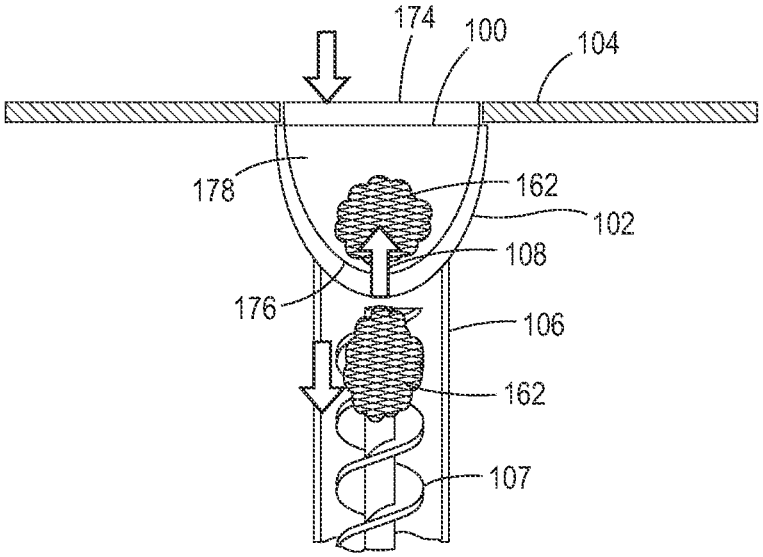
Figure 6A:
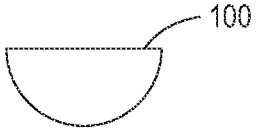
FIGS. 6A-6D are schematic diagrams illustrating a toner storage container of a printing device herein.
Figure 6B:
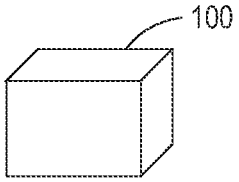
Figure 6C:
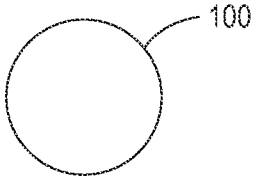
Figure 6D:
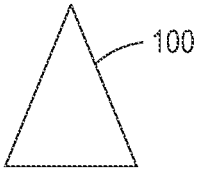

In more detail, as seen in the cross-sectional view in FIG. 5A-5B, the receptacle 102 has a protrusion 108 shaped to pierce the exterior of the toner storage container 100 when the toner storage container 100 is placed in the receptacle 102. The protrusion 108 helps hold the toner storage container 100 in place in the receptacle 102. In some structures, the supply conduit 106 can include an auger 107 that helps move the marking material 162 from the receptacle 102 to the cartridge (through the supply conduit 106).

More specifically, as shown in FIGS. 5A-5B, any form of marking material 162 is maintained in the airtight and water tight interior 178 of the toner storage container 100 (FIG. 5A) until the toner storage container 100 is pushed by the user (as indicated by the block arrow in FIG. 5B) into the receptacle 102. The user's pushing action indicated by the block arrow in FIG. 5B causes the protrusion 108 to pierce the bottom surface 176 of the toner storage container 100. Thus, the process of pushing the toner storage container 100 into the receptacle 102 so that the protrusion 108 pierces the bottom surface 176 of the toner storage container 100 causes the marking material 162 to flow out of the toner storage container 100 and into the supply conduit 106, and to pass through the supply conduit 106, as potentially aided by the auger 107, to refill the cartridge 170, as illustrated in FIG. 5B.

As noted above, the receptacle 102 has a protrusion 108 that pierces the lower surface as the toner storage container 100, when the toner storage container 100 is placed in the receptacle 102 to form an opening in the lower surface 176. Also, the airtight and watertight interior 178 of the toner storage container 100 is larger than the protrusion 108, and this prevents the protrusion 108 from piercing the upper surface of the toner storage container 100, keeping toner 162 from being released anywhere except into the receptacle 102 and conduit 106, so as to resupply marking material 162 to the cartridge 170 within the interior of the printing device 104 in a very clean operation that does not expose toner to the user. Additionally, the airtight and watertight interior 178 of the toner storage container 100 is larger than the auger 107, to accommodate the auger 107 (which potentially may be an integral element of the protrusion 108) without piercing the upper surface of the toner storage container 100.

In some examples as seen in FIG. 5B, the toner storage container 100 itself has a planar upper ("first") surface 174 that is parallel to an adjacent portion of the exterior of the device body 104 (when the toner storage container 100 is positioned in the exterior mounted receptacle 102) and a curved lower ("second") surface 176 that has a shape matching the curved shape of the receptacle 102. However, as shown in FIGS. 6A-6D, the upper surface 174 does not need to be planar, and the lower surface 176 of the toner storage container 100 is not necessarily curved, but instead is shaped to match the shape of the receptacle 102 of the printing device 104. Therefore, in some limited examples, the toner storage container 100 (and the corresponding receptacle 102) can have the shape of a half-sphere (FIG. 6A); a cube or rectangular box (FIG. 6B); a sphere (FIG. 6C); a triangular shaped three dimensional structure (FIG. 6D); etc. Irrespective of the shape of the toner storage container 100 (and the corresponding receptacle 102) an airtight and watertight interior 178 is formed between the first surface 174 and the second surface 176, and the airtight and watertight interior 178 maintains only the marking material 162 (and possibly air). The airtight and watertight interior 178 maintains the marking material 162 until pierced by the protrusion 108 to further maintain a clean experience for the user, and to reduce the possibility of toner spills. Further, the upper ("first") surface 174 and the lower ("second") surface 176 can be made of different materials or the same material.

Also, the "marking material" 162 discussed above can be toner or any other marking material (dry ink, wet ink, powdered ink, etc.) and the term "toner" is used sometimes herein as a shorthand term for any form of marking material that a printer may use.

Figure 7:
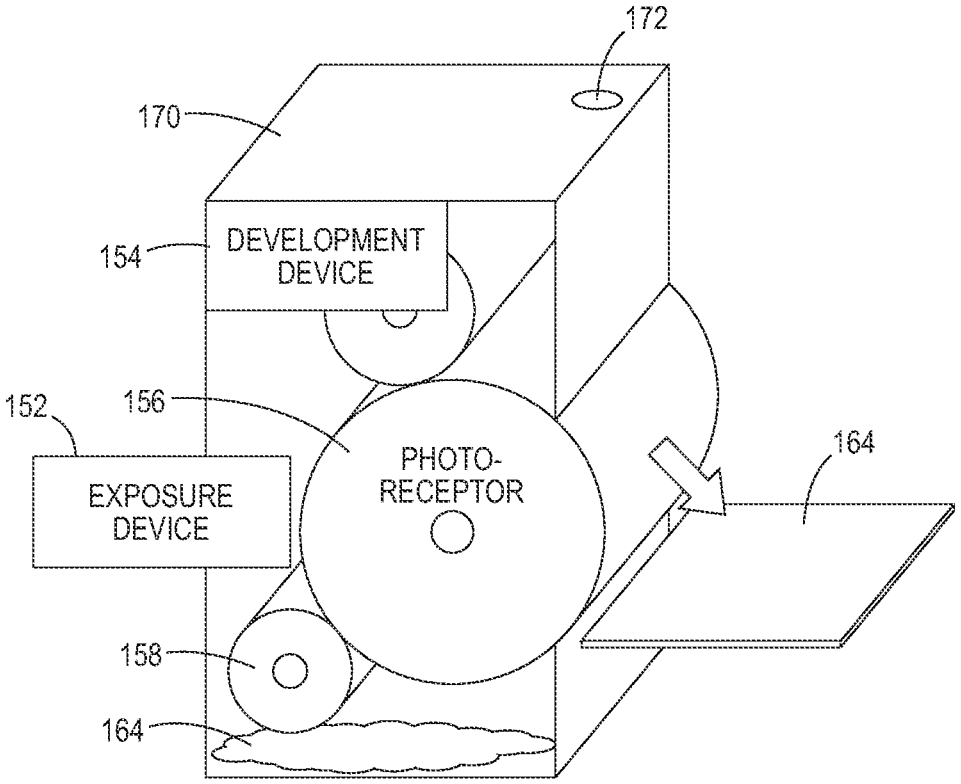
FIG. 7 is a schematic diagram illustrating a cartridge of a printing device herein.

As shown in FIG. 7, the cartridge 170 or "separate marking material cartridge" can be a toner cartridge or any form of printer cartridge that includes marking material, printing components, circuitry, an auger, etc., and is distinguished from the toner storage container 100 that merely maintains only marking material (and possibly air) by such additional printing hardware components. More specifically, the toner cartridge can include a photoreceptor 156, a charging station 158 that creates a uniform charge on the photoreceptor 156, an internal exposure device 152 that patterns the uniform charge, and an internal development device 154 that transfers marking material 162 to the photoreceptor 156. The pattern of marking material is then transferred from the photoreceptor 156 to the print media.

Figure 8:
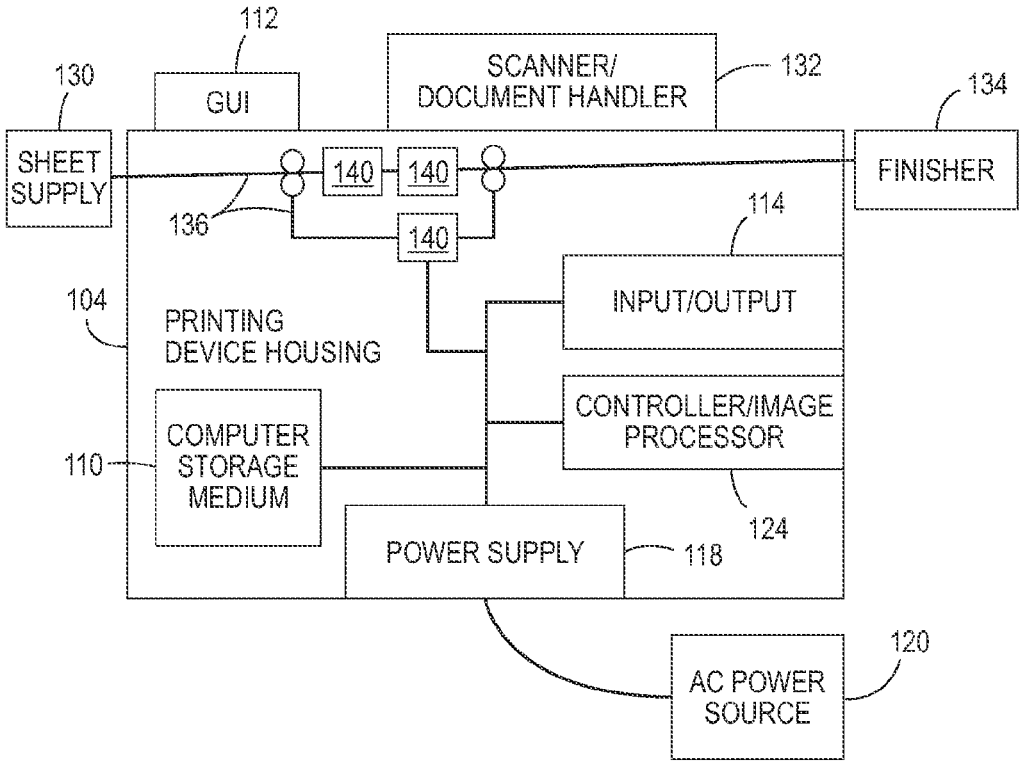
FIG. 8 is a schematic diagram illustrating printing devices herein.

FIG. 8 illustrates a computerized device that is a printing device 104, which can be used with systems and methods herein and can comprise, for example, a printer, copier, multi-function machine, multi-function device (MFD), etc. The printing device 104 includes a controller/tangible processor 124 and a communications port (input/output) 114 operatively connected to the tangible processor 124 and to the computerized external to the printing device 104. Also, the printing device 104 can include at least one accessory functional component, such as a graphical user interface (GUI) assembly 112. The user may receive messages, instructions, and menu options from, and enter instructions through, the graphical user interface or control panel 112.

The input/output device 114 is used for communications to and from the printing device 104 and comprises a wired device or wireless device (of any form, whether currently known or developed in the future). The tangible processor 124 controls the various actions of the computerized device. A non-transitory, tangible, computer storage medium device 110 (which can be optical, magnetic, capacitor based, etc., and is different from a transitory signal) is readable by the tangible processor 124 and stores instructions that the tangible processor 124 executes to allow the computerized device to perform its various functions, such as those described herein. Thus, as shown in FIG. 8, a body housing has one or more functional components that operate on power supplied from an alternating current (AC) source 120 by the power supply 118. The power supply 118 can comprise a common power conversion unit, power storage element (e.g., a battery, etc), etc.

The printing device 104 includes at least one marking device (printing engine(s)) 140 operatively connected to a specialized image processor 124 (that is different than a general purpose computer because it is specialized for processing image data), a media path 136 positioned to supply continuous media or sheets of media from a sheet supply 130 to the marking device(s) 140, etc. After receiving various markings from the printing engine(s) 140, the sheets of media can optionally pass to a finisher 134 which can fold, staple, sort, etc., the various printed sheets. Also, the printing device 104 can include at least one accessory functional component (such as a scanner/document handler 132 (automatic document feeder (ADF)), etc.) that also operate on the power supplied from the external power source 120 (through the power supply 118).

The one or more printing engines 140 are intended to illustrate any marking device that applies a marking material (toner, inks, etc.) to continuous media or sheets of media, whether currently known or developed in the future and can include, for example, devices that use the toner cartridge 170 discussed above.

Thus, in printing devices herein a latent image can be developed with developing material to form a toner image corresponding to the latent image. Then, a sheet is fed from a selected paper tray supply to a sheet transport for travel to a transfer station. There, the image is transferred to a print media material, to which it may be permanently fixed by a fusing device. The print media is then transported by the sheet output transport 136 to output trays or a multi-function finishing station 134 performing different desired actions, such as stapling, hole-punching and C or Z-folding, a modular booklet maker, etc., although those ordinarily skilled in the art would understand that the finisher/output tray 134 could comprise any functional unit.

As would be understood by those ordinarily skilled in the art, the printing device 104 shown in FIG. 8 is only one example and the systems and methods herein are equally applicable to other types of printing devices that may include fewer components or more components. For example, while a limited number of printing engines and paper paths are illustrated in FIG. 8, those ordinarily skilled in the art would understand that many more paper paths and additional printing engines could be included within any printing device used with systems and methods herein.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicant does not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A printing apparatus comprising:

a feeder feeding print media;

a photoreceptor positioned relative to said feeder to receive said print media from said feeder;

cartridge connections positioned within said printing apparatus;

a retrofit cartridge connected to said cartridge connections, an original supply of marking material being maintained within a portion of said retrofit cartridge, said retrofit cartridge being positioned relative to said photoreceptor to supply said marking material from said original supply of marking material within said retrofit cartridge to said photoreceptor, said photoreceptor transferring said marking material to said print media during printing activities;

a receptacle connected to said retrofit cartridge; and a storage container in said receptacle, said retrofit cartridge and said receptacle comprising a retrofit structure that replaces an existing cartridge having marking material consumed by said printing activities, said existing cartridge lacking said receptacle, said existing cartridge and said retrofit cartridge having matching connections to connect to said cartridge connections, said storage container containing only said marking material, said storage container being smaller than said portion of said retrofit cartridge, said storage container refilling said original supply of said marking material within said retrofit cartridge through said receptacle, said storage container being removable from said receptacle after refilling said retrofit cartridge, allowing said retrofit cartridge to supply said marking material from said original supply of marking material within said retrofit cartridge to said photoreceptor, and said storage container being a physically separate component from said retrofit cartridge.

2. The printing apparatus of claim 1, said receptacle comprising a protrusion piercing said storage container as said storage container is placed in said receptacle.

3. The printing apparatus of claim 2, said protrusion holding said storage container in place in said receptacle.

4. The printing apparatus of claim 1, further comprising an auger moving said marking material from said receptacle to said retrofit cartridge.

5. The printing apparatus of claim 1, said storage container comprising:

a planar first surface; and a curved second surface having a shape matching a curved shape of said receptacle.

6. A printing apparatus comprising:

a device body having an exterior and an interior;

a feeder feeding print media within said interior of said device body;

a photoreceptor positioned within said interior of said device body to receive said print media from said feeder;

cartridge connections positioned within said interior of said device body;

a retrofit cartridge within said interior of said device body connected to said cartridge connections, said retrofit cartridge maintaining marking material and being positioned to supply said marking material to said photoreceptor, said photoreceptor transferring said marking material to said print media during printing activities;

a receptacle on said exterior of said device body and connected to said retrofit cartridge; and a storage container positioned exterior to said device body in said receptacle, said retrofit cartridge and said receptacle comprising a retrofit structure that replaces an existing cartridge having marking material consumed by said printing activities, said existing cartridge lacking said receptacle, said existing cartridge and said retrofit cartridge having matching connections to connect to said cartridge connections, said storage container containing only said marking material, said storage container supplying said marking material to said retrofit cartridge through said receptacle, and said storage container being a physically separate component from said retrofit cartridge.

7. The printing apparatus of claim 6, said receptacle comprising a protrusion piercing said storage container as said storage container is placed in said receptacle.

8. The printing apparatus of claim 7, said protrusion holding said storage container in place in said receptacle.

9. The printing apparatus of claim 6, further comprising an auger moving said marking material from said receptacle to said retrofit cartridge.

10. The printing apparatus of claim 6, said storage container comprising:

a planar first surface that is parallel to an adjacent portion of said exterior of said device body when said storage container is positioned in said receptacle; and a curved second surface having a shape matching a curved shape of said receptacle.

11. A printing apparatus comprising:

a device body having an exterior and an interior;

a sheet feeder feeding print media within said interior of said device body;

cartridge connections positioned within said interior of said device body;

a retrofit cartridge positioned within said interior of said device body connected to said cartridge connections to receive said print media from said sheet feeder;

a photoreceptor within said retrofit cartridge;

marking material within said retrofit cartridge, said photoreceptor transferring said marking material from within said retrofit cartridge in a pattern to said print media during printing activities;

a receptacle on said exterior of said device body;

a supply conduit connected to said retrofit cartridge and to said receptacle; and a storage container positioned exterior to said device body in said receptacle, said retrofit cartridge, said receptacle, and supply conduit comprising a retrofit structure that replaces an existing cartridge having marking material consumed by printing activities, said existing cartridge lacking said receptacle and said supply conduit, said existing cartridge and said retrofit cartridge having matching connections to connect to said cartridge connections, said storage container containing only said marking material, said storage container supplying said marking material to said retrofit cartridge through said supply conduit, and said storage container being a physically separate component from said retrofit cartridge.

12. The printing apparatus of claim 11, said receptacle comprising a protrusion piercing said storage container as said storage container is placed in said receptacle.

13. The printing apparatus of claim 12, said protrusion holding said storage container in place in said receptacle.

14. The printing apparatus of claim 11, said supply conduit comprising an auger moving said marking material from said receptacle to said retrofit cartridge through said supply conduit.

15. The printing apparatus of claim 11, said storage container comprising:

a planar first surface that is parallel to an adjacent portion of said exterior of said device body when said storage container is positioned in said receptacle; and a curved second surface having a shape matching a curved shape of said receptacle.

* * * * *